US011946468B2

(12) United States Patent
Lindholdt et al.

(10) Patent No.: US 11,946,468 B2
(45) Date of Patent: Apr. 2, 2024

(54) HYDRAULIC MACHINE WITH CONTROLLABLE VALVES AND METHOD FOR IDLING SUCH A HYDRAULIC MACHINE

(71) Applicant: DIINEF AS, Grimstad (NO)

(72) Inventors: Per Nielsen Lindholdt, Århus (DK); Geir-Kjetil Nerland, Hustad (NO); Henrik Bollerup Larsen, Stabekk (NO)

(73) Assignee: DIINEF AS, Grimstad (NO)

( * ) Notice: Subject to any disclaimer, the term of this patent is extended or adjusted under 35 U.S.C. 154(b) by 288 days.

(21) Appl. No.: 17/415,963

(22) PCT Filed: Dec. 20, 2019

(86) PCT No.: PCT/NO2019/050287
§ 371 (c)(1),
(2) Date: Jun. 18, 2021

(87) PCT Pub. No.: WO2020/130851
PCT Pub. Date: Jun. 25, 2020

(65) Prior Publication Data

US 2021/0381503 A1 Dec. 9, 2021

(30) Foreign Application Priority Data

Dec. 20, 2018 (NO) ..... 20181659

(51) Int. Cl.
*F04B 49/03* (2006.01)
*F04B 1/06* (2020.01)
(Continued)

(52) U.S. Cl.
CPC ..... *F04B 49/03* (2013.01); *F04B 1/06* (2013.01); *F04B 7/0076* (2013.01);
(Continued)

(58) Field of Classification Search
CPC ..... F04B 7/0076; F04B 49/22; F04B 49/065; F04B 51/00; F04B 49/24; F04B 1/06;
(Continued)

(56) References Cited

U.S. PATENT DOCUMENTS 9,091,253 B2 * 7/2015 Stein ..... F01B 15/06
9,828,986 B2 * 11/2017 Caldwell ..... F04B 51/00
(Continued)

FOREIGN PATENT DOCUMENTS

CN 101813104 A 8/2010
CN 102124221 A 7/2011
(Continued)

OTHER PUBLICATIONS

International Search for PCT/NO2019/050287 dated Apr. 28, 2020.
Written Opinion of the International Searching Authority for PCT/NO2019/050287 dated Apr. 28, 2020.

*Primary Examiner* — Peter J Bertheaud
(74) *Attorney, Agent, or Firm* — Birch, Stewart, Kolasch & Birch, LLP

(57) ABSTRACT

Idling a hydraulic machine includes electronically controlled high and low-pressure valves, a control system arranged to control opening and closing of said valves, a first idle safety valve arrangement arranged between the first working chamber and a fluid sink with a pressure equal to or lower than the high pressure, operating the hydraulic machine in an empty cylinder idle mode, wherein the high and low-pressure valves are concurrently closed for at least a whole cycle of the varying volume, and releasing hydraulic fluid to the fluid sink only when fluid pressure in the working chamber increases above a set threshold and the empty cylinder mode is enabled, enabling the first idle safety valve arrangement when the hydraulic machine operates in the empty cylinder idle mode, and disabling when not.

15 Claims, 5 Drawing Sheets

(51) Int. Cl.

| | |
|---|---|
| ***F04B 7/00*** | (2006.01) |
| ***F04B 49/02*** | (2006.01) |
| ***F04B 49/06*** | (2006.01) |
| ***F04B 49/08*** | (2006.01) |
| ***F04B 49/24*** | (2006.01) |
| ***F04B 51/00*** | (2006.01) |
| ***F04B 53/10*** | (2006.01) |

(52) U.S. Cl.
CPC ..... *F04B 49/022* (2013.01); *F04B 49/06* (2013.01); *F04B 49/065* (2013.01); *F04B 49/08* (2013.01); *F04B 49/24* (2013.01); *F04B 51/00* (2013.01); *F04B 53/10* (2013.01)

(58) Field of Classification Search
CPC ..... F04B 49/08; F04B 53/10; F04B 49/03; F04B 49/022; F04B 49/06
See application file for complete search history.

(56) References Cited

U.S. PATENT DOCUMENTS

| | | | |
|---|---|---|---|
| 2010/0243067 | A1 | 9/2010 | Stein et al. |
| 2011/0017308 | A1 | 1/2011 | Linjama et al. |
| 2011/0268590 | A1 | 11/2011 | Stein et al. |
| 2012/0186659 | A1 | 7/2012 | Lumkes et al. |
| 2013/0221676 | A1 | 8/2013 | Caldwell et al. |
| 2017/0284388 | A1 | 10/2017 | Caldwell et al. |

FOREIGN PATENT DOCUMENTS

| | | | |
|---|---|---|---|
| EP | 1 979 614 | B1 | 12/2013 |
| WO | WO2015/112025 | A1 | 7/2015 |

* cited by examiner

HYDRAULIC MACHINE WITH CONTROLLABLE VALVES AND METHOD FOR IDLING SUCH A HYDRAULIC MACHINE

TECHNICAL FIELD

The present invention relates to hydraulic machines, such as hydraulic motors and hydraulic pumps. More specifically, it relates to fully or partly idling of hydraulic machines with valves controlled from a control system, such as electronically controlled valves.

BACKGROUND

In order to reduce losses in hydraulic motors under certain operating conditions, such as e.g. traction systems, free fall operations, emergency release etc., idling or freewheeling operation of the hydraulic motor is known. In the freewheeling condition the hydraulic motor should absorb as little power as possible at varying rotational speeds.

One way of implementing freewheeling is to empty cylinders in traditional radial piston High Torque, Low Speed (HTLS) motors. It is known to run the motor with cylinders partly filled with oil, with air, with pressurized air, and short circuit input and output ports. The actual configuration is selected based on the rotational speed, requirements for control, duration of freewheeling etc.

Further, with electrically actuated valves it has become possible to idle cylinders by connecting the cylinder to the low-pressure side during whole working cycles. This way, oil is pumped in and out of the cylinder with the dominant losses being valve losses from the oil passing back and forth through the open low-pressure valve to the low-pressure manifold, and from the friction of the piston sliding in the cylinder and other friction losses inside the motor which depends on the motor topology but most of which increase with cylinder pressure. In idle mode, this pressure varies around the pressure in the low pressure manifold.

Another challenge, which is related to the valve losses, is the torque-speed characteristics that follows. The maximum speed defined by the valve capacity is the same from idle to full displacement. For a number of applications, it would be more advantageous if a higher speed by reduced displacement could be obtained.

Pressure losses across the low-pressure valves increase with the square of the flow passing through said valve, meaning that losses will increase roughly with the square of the motor speed.

US2010243067 A1 describes a hydraulic machine has at least one working chamber of cyclically changing volume, and low- and high-pressure valve means to control the connection of the or each chamber to low- and high-pressure lines) respectively. A method of operating the machine includes holding the low-pressure valve means closed during at least an entire cycle of the chamber, starting at minimum chamber volume, such that gas dissolved in liquid in the chamber is released therefrom during an expansion of the chamber volume and re-dissolved during a reduction thereof.

US2013221676 A1 describes a hydraulic circuit comprising a hydraulic pump driven by a rotating shaft and a hydraulic motor driving an electricity generator, or other load. A high pressure manifold extending between the pump and motor is in communication with an accumulator. A controller receives a control signal and regulates the displacement of working fluid by the hydraulic pump and the hydraulic motor relative to each other.

US2011017308 A1 discloses an apparatus comprising a series of units, each being capable of producing a volume flow; a first channel for supplying hydraulic fluid into the apparatus; a second channel for supplying hydraulic fluid from the apparatus; a first series of valves comprising at least one controlled valve for each unit; a third channel for supplying hydraulic fluid from the apparatus; and several controlled auxiliary valves, each being provided for one unit.

US2012186659A1 discloses a fluid control valve system including at least one check valve assembly that has a controllable bidirectional flow capability. The valve system and its check valve assembly can be installed in a fluid system that contains a pump/motor to enable the displacement output of the pump/motor to be controlled. The valve system further includes a pilot valve assembly and a device for controlling the check and pilot valve assemblies.

EP1979614 discloses a method wherein both the high pressure valve and the low pressure valve are closed when the cylinder volume during a cycle reaches exactly its minimum volume position, whereafter rotation is continued and vapor releases from the oil during expansion.

However, the latter method has some limitations related to hydraulic machines with real world valves and with internal leakages, increasing losses and wear. In addition, and as a consequence of the losses, the method is also associated with a noise.

SHORT SUMMARY

A goal with the present invention is to overcome the problems of prior art, and reduce the losses from idling working chambers. Further, the noise level from such idling machines may be reduced. This is achieved by the hydraulic machine and the method for idling a hydraulic machine according to the accompanying independent claims.

One of the problems with losses and wear in prior art is that it has an inherent risk of having slightly more oil enclosed inside the cylinder than the minimum cylinder volume, since precise closure of valves is not practically achievable. As a consequence, the pressure inside the cylinder will peak at high pressure every time the cylinder volume is at its minimum, and these peaks may increase motor wear as well as increase losses and noise.

As a result of the invention, these problems have been adressed and solved. One of the advantages of embodiments of the invention is that the pressure drop across the valves have been reduced. Another advantage of embodiments of the invention is that the pressure in the working chamber in the idling part of the cyclus where momentum is not produced, has been reduced.

Thus, the invention allows idling of a working machine with real valves and with some internal leakage in both valves and motor.

When losses and wear is reduced, it is also possible to increase rotational speed of the hydraulic machine when one or more of the working chambers are idling. This in turn increases the versatility and efficiency of the hydraulic machine in different operating conditions and applications.

Below the volume diagram, possible state diagrams for the idle safety valve (24), the high pressure valve (10H) and the low pressure valve (10L) are shown. "0" indicates a closed valve, while "1" indicates that the valve is open.

For illustration purposes, an example of the resulting chamber pressure of the working chamber (4) is illustrated at the bottom, where the lowest stapled line indicates vapor pressure (Pv), the stapled line above, a low pressure (Pl), and the highest line, high pressure (Ph).

Figure 3:
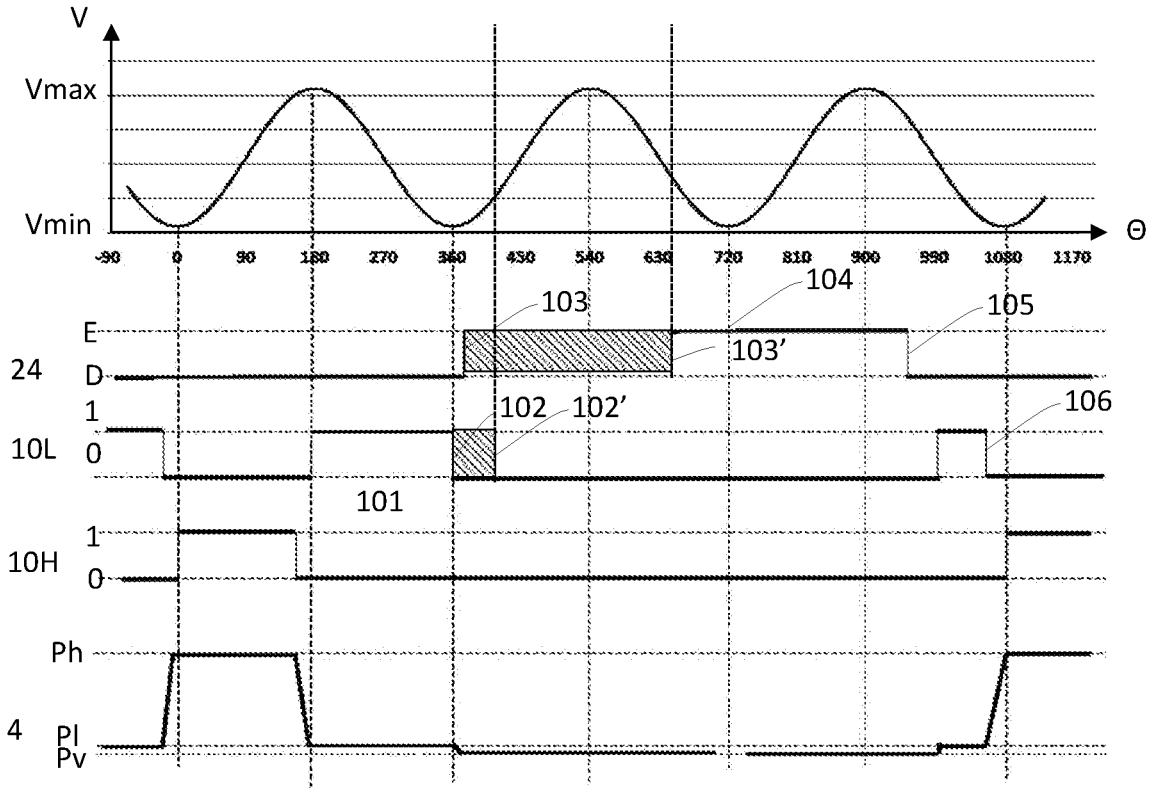
FIG. 3 illustrates in a combined valve state and working chamber volume diagram, the hydraulic machine empty cylinder idle mode, according to an embodiment of the invention, where the hydraulic machine is in pumping mode. In the upper graph, the shaft angle (θ) can be seen along the horizontal axis and the cyclically varying volume (V) of the working chamber can be seen on the vertical axis.
Figure 4:
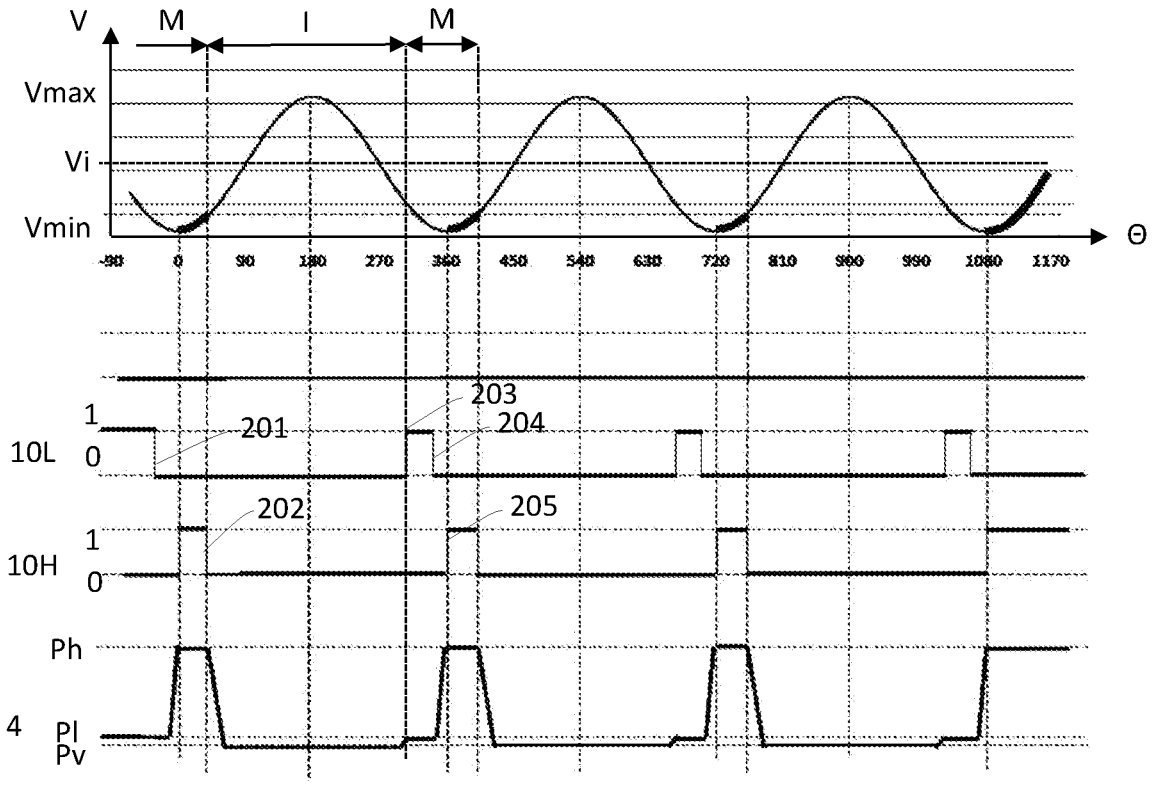

FIG. 4 illustrate in a similar representation as in FIG. 3 the hydraulic machine in a low torque mode, according to an embodiment of the invention, where the working chamber is idling in most of the cycle. In the illustrated example, the hydraulic machine (1) is in normal motor mode to the left in the figure before it enters into the low torque motor mode for three cycles and then returns to normal motor mode again.

Figure 5:
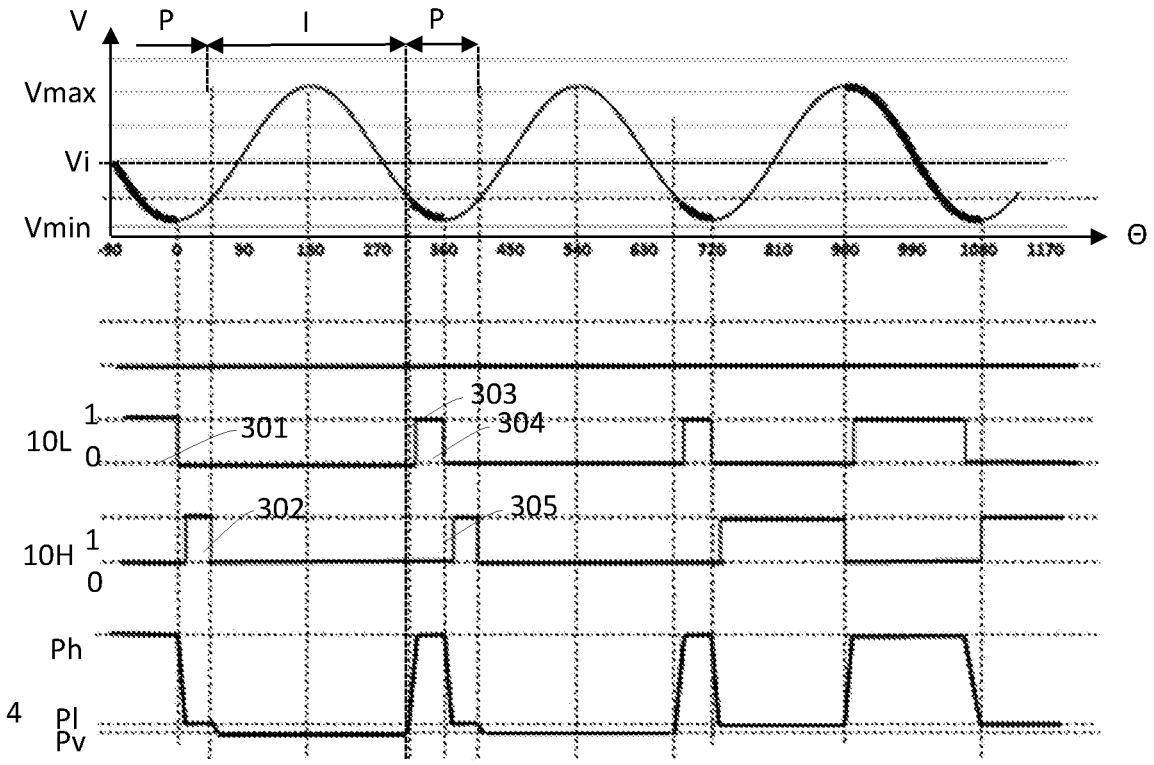

FIG. 5 illustrate in a similar representation as in FIG. 4, the hydraulic machine in a low torque mode, according to an embodiment of the invention, where the working chamber is idling in most of the cycle. In the illustrated example, the hydraulic machine (1) is in normal pump mode to the left in the figure before it enters into the low torque pump mode for two cycles and then returns to normal pump mode again.

In the graphs above, it is assumed instant valve shifts, pressure independant compressibility of hydraulic fluid, and that evaporation pressure is constant. Pressure drop across valves is not included.

EMBODIMENTS OF THE INVENTION

In the following description, various examples and embodiments of the invention are set forth in order to provide the skilled person with a more thorough understanding of the invention. The specific details described in the context of the various embodiments and with reference to the attached drawings are not intended to be construed as limitations. Rather, the scope of the invention is defined in the appended claims.

The embodiments described below are numbered. In addition, dependent embodiments defined in relation to the numbered embodiments are described. Unless otherwise specified, any embodiment that can be combined with one or more numbered embodiments may also be combined directly with any of the dependent embodiments of the numbered embodiment(s) referred to.

Figure 1:
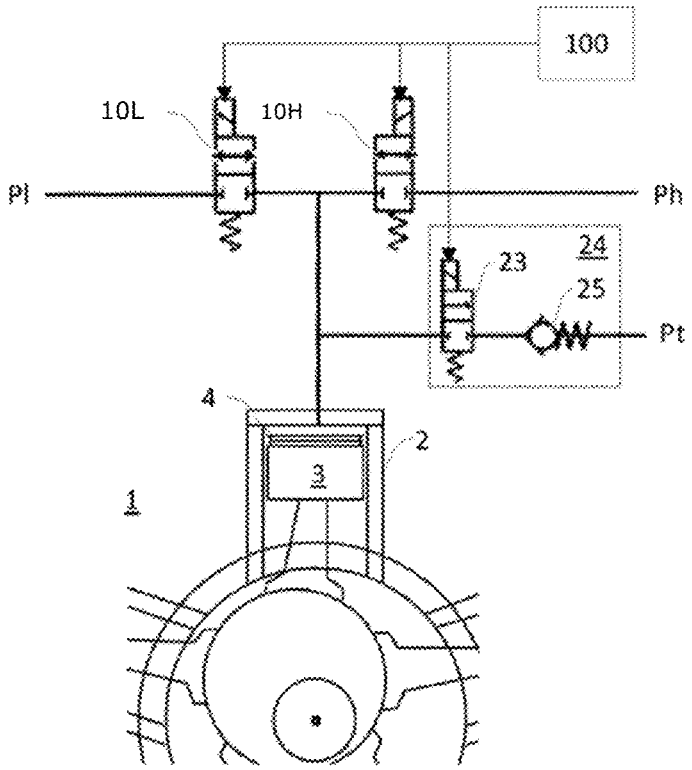
FIGS. 1 and 2 illustrate in a schematic view a hydraulic machine (1) according to the invention.

The hydraulic machine (1) comprises in a first machine embodiment of the invention, illustrated in FIG. 1, a working chamber (4) with cyclically varying volume (V). The working chamber is here limited by a piston (3) inside a cylinder (2). Further, the hydraulic machine (1) comprises high and low-pressure valves (10H, 101L) arranged between fluid source and sink with high and low pressure (Ph, Pl) and the working chamber (4), respectively. The valves are controllable, such as hydraulically or electronically actuated valves.

The hydraulic machine also comprises a control system (100) arranged to control opening and closing of the high and low-pressure valves (10H, 10L).

In a dependent embodiment, the hydraulic machine comprises an idle safety valve arrangement (24) arranged between the working chamber (4) and a fluid sink with a pressure equal to or lower than the high pressure (Ph). The pressure may in an embodiment be equal to or lower than low pressure (Pl). It may also be the tank pressure (Pt).

The first idle safety valve arrangement (24) may be configured to release hydraulic fluid to the fluid sink when it is enabled and if a fluid pressure in the first working chamber (4) increases above a set threshold.

Figure 2:
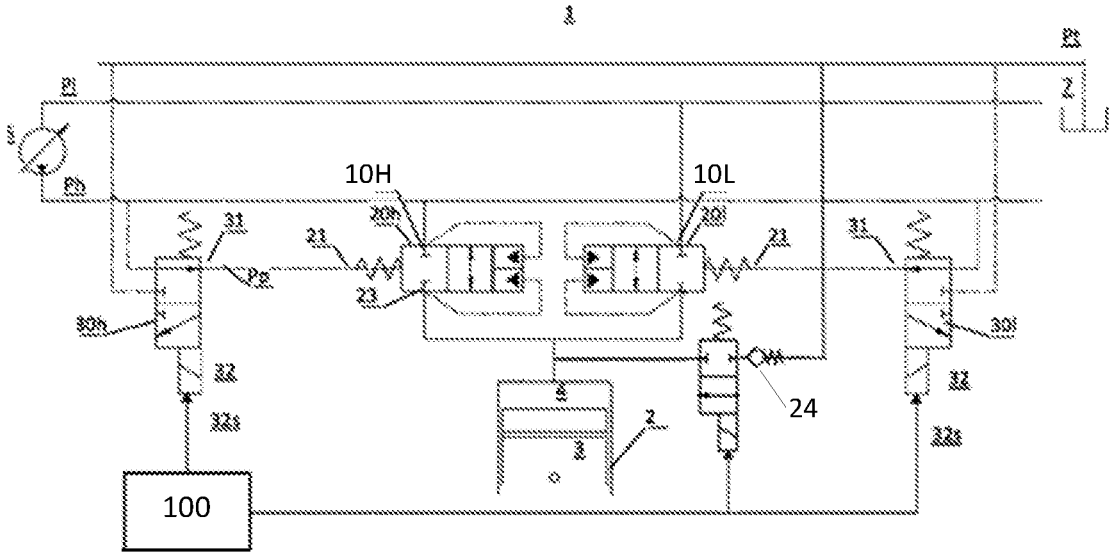

In a second machine embodiment of the hydraulic machine (1) shown in FIG. 2, the first pilot pressure control means (30*h*) is implemented as a hydraulic valve arranged to be connected to a high pressure line (Ph) and a tank line (Pt), and the output pilot pressure on the pilot main port (31) can be switched between high pressure (Ph) and tank pressure (Pt) by opening or closing the valve. The value of the control signal (32) determines the state of the valve and thereby the pilot hydraulic pressure (Pp). The valves of the pilot pressure control means (30*h*, 30*l*) may be e.g. spool valves or poppet valves. The high and low pressure valves (10H, 10L) are hydraulically operated by the pilot pressure from the first and second pilot pressure control means (30*h*, 30*l*).

In an alternative embodiment the first pilot pressure control means (30*h*) is implemented as a pressure control valve arranged to be connected to a high pressure line (Ph) and a tank line (Pt), and the output pilot pressure on the pilot main port (31) can be varied between high pressure (Ph) and tank pressure (Pt) by opening or closing the valve. The value of the control signal (32) determines the state of the valve and thereby the pilot hydraulic pressure (Pp).

Alternatively, the hydraulic valve or pressure control valves are connected to the high pressure line (Ph) and a low pressure line (Pl) of the systems shown in FIG. 2. Yet another alternative embodiment is that at least one of the sources are independent of the pressure lines used by the hydraulic machine, e.g. a higher pressure line with a higher pressure than the high pressure line (Ph), and a lower pressure line with a lower pressure than the high pressure line (Pl). As long as the pressure lines used enable the first and second pilot pressure control means (30*h*, 30*l*) to open and close the valves (10*h*, 10*l*) as intended by the operation, the actual source is not critical for the invention.

Variable pilot pressure may be used to achieve torque control of the hydraulic machine. In an embodiment the torque of the motor is controlled by varying the pilot hydraulic pressure (Pp) on the pilot port (21) on the valve connected to the low pressure line (Pl) during compression.

In a dependent embodiment the hydraulic machine (1) comprises a first idle safety valve arrangement (24) arranged between the first working chamber (4) and a low pressure tank (Pt), and configured to release hydraulic fluid to the tank (Pt) if the pressure in the first working chamber (4) increases above a set threshold.

In a third machine embodiment that may be combined with the first or second machine embodiments above, and any of their dependent embodiments, the control system (100) is configured to keep the high and low-pressure valves (10H, 10L) closed in a majority of the expansion and compression phase of the first working chamber (4) to idle the hydraulic machine (1).

In a first dependent embodiment, the control system (100) is configured to maintain the fluid pressure in the working chamber (4) at vapor pressure (Pv) when the high and low pressure valves (10H, 10L) are both closed.

In a fourth machine embodiment, that may be combined with any of the third machine embodiment and its dependent embodiments, the control system (100) is configured to operate the hydraulic machine (1) in an empty cylinder idle mode, and to keep the high and low-pressure valves (10H, 10L) concurrently closed for at least a whole cycle of the varying volume (V), wherein the hydraulic machine (1) comprises a first idle safety valve arrangement (24) arranged between the first working chamber (4) and a fluid sink with a pressure equal to or lower than the high pressure (Ph), wherein the first idle safety valve arrangement (24) is configured to release hydraulic fluid to the fluid sink when it is enabled and if a fluid pressure in the first working chamber (4) increases above a set threshold, wherein the control system (100) is arranged to enable the first idle safety valve arrangement (24) when the hydraulic machine operates in the empty cylinder idle mode, and disable the first idle safety valve arrangement (24) when the hydraulic machine does not operate in the empty cylinder idle mode.

The pressure of the fluid sink may in alternative embodiments be equal or lower than the low pressure (PI) or the tank pressure (Pt).

In a first dependent embodiment, the valve arrangement (24) comprises a check valve (25) arranged to release pressure to the fluid sink. The valve arrangement (24) may further comprise a valve (23) arranged in in series with the check valve (25). The valve (23) may comprise any combination of the following features:

a two way valve, a solenoid connected to the control system (100).

normally open or normally closed the order of the check valve (25) and the valve (23) may be interchanged.

Other implementations are possible, as will be understood by a person skilled in the art.

The hydraulic machine (1) may be a motor or a pump.

The invention comprises in a first general embodiment a method for idling a hydraulic machine (1), wherein the hydraulic machine (1) comprises at least one working chamber (4) with cyclically varying volume (V), controllable high and low-pressure valves (10H, 101L) arranged between fluid source and sink with high and low pressure (Ph, PI) and the working chamber (4), respectively, and a control system (100) arranged to control opening and closing of said high and low-pressure valves (10H, 10L), wherein the method comprises;

keeping the high and low-pressure valves (10H, 10L) closed in a majority of the expansion and compression phase of the first working chamber (4) to idle the hydraulic machine (1).

In a first dependent embodiment the method comprises;

keeping the high and low-pressure valves (10H, 10L) closed when volume (V) is larger than a set volume. The set volume may in different embodiments be e.g. 10%, 20%, or 30%.

In second dependent embodiment that may be combined with any of the first general embodiment and the first dependent embodiment above, the method comprises maintaining the fluid pressure in the working chamber (4) at vapor pressure (Pv) when the high and low pressure valves (10H, 10L) are both closed.

The invention is in a first empty cylinder mode embodiment a method that may be combined with the general embodiment above, or any of its dependent embodiments, wherein the method comprises operating the hydraulic machine (1) in an empty cylinder idle mode, wherein the high and low-pressure valves (10H, 10L) are concurrently closed for at least a whole cycle of the varying volume (V), and releasing hydraulic fluid to the fluid sink only when empty cylinder mode is enabled if fluid pressure in the working chamber (4) increases above a set threshold.

In a first dependent embodiment, the hydraulic machine (1) comprises a first idle safety valve arrangement (24) arranged between the first working chamber (4) and a fluid sink with a tank pressure (Pt) lower than the low pressure (PI), wherein the method comprises;

enabling the first idle safety valve arrangement (24) when the hydraulic machine operates in the empty cylinder idle mode, and disabling the first idle safety valve arrangement (24) when the hydraulic machine does not operate in the empty cylinder idle mode.

FIG. 3, illustrates to the left a possible entry point for this mode, where an empty cylinder mode where the working chamber (4) is coming from motoring mode where the high pressure valve (10H) is closed and the low pressure valve (10L) is open during compression. Further the first idle safety valve arrangement (24) is disabled.

In a second empty cylinder mode embodiment a method that may be combined with any of the first empty cylinder mode and its dependent embodiments, the method comprises closing the low pressure valve (10L) immediately after minimum working chamber volume (Vmin) is passed (102).

In a first dependent embodiment that may be combined with any of the second empty cylinder mode embodiment and its dependent embodiments above, the method comprises enabling the first idle safety valve arrangement (24) after closing of the low pressure valve (10L) and before the working chamber volume (V) is reduced to the same volume as was present when the low pressure valve (10L) was closed (10).

The first idle safety valve arrangement (24) will then let out the excess oil volume during the last part of the first idle cycle (104), i.e. when the working chamber reaches minimum volume (Vmin) the first time after first idle safety valve arrangement (24) was enabled.

The second time the working chamber volume (V) reaches minimum (not illustrated), the idle safety valve arrangement (24) would let out any oil that has flown into the working chamber (4) due to internal leakages.

In FIG. 3, it is illustrated that the low pressure valve (10L) may in an embodiment be closed after minimum working chamber volume (V) has been passed (102') and that first idle safety valve arrangement (24) may be enabled some time after (103'). The check valve (24) should here be opened sufficiently early to allow the amount of fluid that entered into the working chamber when the low pressure valve (10L) was left open in the first part of expansion phase, out of the working chamber (4), as soon as the fluid is compressed above the threshold of the opening of the checkvalve.

In this case, the working chamber is filled with some oil in beginning of compression until the low pressure valve (10L) is closed, but as long as the check valve (24) is enabled (E) sufficiently early before the oil is compressing, the check valve (24) will open and let the oil out of the working chamber (4).

In a third empty cylinder mode embodiment that may be combined with the first empty cylinder mode embodiment and any of its dependent embodiments, the working chamber (4) is coming from pump mode where high pressure valve (10H) is open, the low pressure valve (10L) is closed during compression and the check valve is disabled (D), the following steps are performed by the control system;

closing the high pressure valve (10H) immediately after minimum working chamber volume (V) is passed.

enable the first idle safety valve arrangement (24) after the closure of the high pressure valve (10H) and before the working chamber volume (V) is reduced to the same volume as was present when the high pressure valve (10H) was closed.

The first idle safety valve arrangement (24) will then let out the excess oil volume during the last part of the first idle cycle, i.e. when the working chamber volume (V) reaches minimum for the first time.

The second time the working chamber volume (V) reaches minimum, the check-valve would let out any oil that has flown into the working chamber (4) due to internal leakages.

When returning to pump mode or motor from the empty cylinder idle mode, method may comprise;

disabling the first idle safety valve arrangement (24), opening the low pressure valve (10L), preferably when the cylinder volume is close to minimum (106).

Pump or motor mode can now be resumed. In FIG. 3, the working chamber (4) returns to motor mode.

By opening the low pressure valve (10L) when the working chamber volume (V) is small, the flow needed to fill the cylinder is reduced to a minimum, reducing risk for noise, cavitation and pulsations.

Instead of opening the low pressure valve (10L) when resuming, the high pressure valve (10L) could be opened instead of the Low pressure valve (10L). However, by using the low pressure valve (10L), the risk for cavitation is reduced.

In a first general low torque embodiment, that may be combined with any of the first general embodiment and its dependent embodiments, the invention is a method comprising;

operating the hydraulic machine in a low torque mode, comprising keeping one of the high pressure valve (10H) and the low pressure valve (10L) open in beginning of expansion phase to allow a first amount of fluid (F1) into the working chamber (4), and keeping the one of the high pressure valve (10H) and low pressure valve (10L) closed in the rest of the cycle.

In a first dependent embodiment the method comprises keeping the other of the high pressure valve (10H) and low pressure valve (10L) open in end of compression phase to allow the first amount of fluid (F1) out of the working chamber (4), and keeping the other of high pressure valve (10H) and low pressure valve (10L) closed in the rest of the cycle.

If the hydraulic machine operates as a motor, the one of the high pressure valve (10H) and the low pressure valve (10L) is the High Pressure valve (10H) and the other of the high pressure valve (10H) and the low pressure valve (10L) is the Low pressure valve (10L).

If the hydraulic machine operates as a pump, the one of the high pressure valve (10H) and the low pressure valve (10L) is the Low Pressure valve (10L) and the other of the high pressure valve (10H) and the low pressure valve (10L) is the High pressure valve (10H).

In a first motor low torque method embodiment of the invention that may be combined with any of the first general embodiment and its dependent embodiments, and illustrated in FIG. 4, the working chamber (4) is coming from motoring mode (M), wherein the low pressure valve (10L) is closed (201) before reaching minimum working chamber volume (Vmin) from expansion phase. In a working chamber cycle the method comprises keeping the high pressure valve (10H) open in a beginning of the expansion phase to allow a first amount of fluid (F1) into the working chamber (4), and keeping the high pressure valve (10H) closed in the rest of the cycle.

In a first dependent embodiment, the method comprises keeping the low pressure valve (10L) open in an end of the compression phase to allow the first amount of fluid (F1) out of the working chamber (4), and keeping the low pressure valve (10L) closed in the rest of the cycle.

In a second dependent embodiment that may be combined with any of the motor low torque embodiment and the first dependent embodiment above, the low pressure valve (10L) is opened in compression phase when working chamber pressure reaches low pressure (Pl) (203).

In a third dependent embodiment that may be combined with any of the motor low torque embodiment and any of its dependent embodiments above, the low pressure valve (10L) is closed a time (T1) before reaching minimum working chamber volume (Vmin) sufficient to compress the working chamber fluid to high pressure (Ph) (204).

In a fourth dependent embodiment that may be combined with any of the motor low torque embodiment and its dependent embodiment above, the high pressure valve (10L) is opened when reaching the high pressure (Ph) in working chamber (4) (205).

In a fifth dependent embodiment that may be combined with any of the motor low torque embodiment and its dependent embodiment above, the high pressure valve (10H) is closed before the working chamber volume (V) has expanded to 1/3 or 1/4 of the maximum volume of the working chamber (4) (202). Further expansion will lower pressure in working chamber (4) to vapour pressure (Pv).

As long as low torque mode is desired, the cycle may be repeated.

Any of the first to fifth dependent embodiments above, may also be combined independently, or together with the first general low torque embodiment above, or its dependent embodiment.

The exact opening of the low pressure valve (10L) (203) may in an embodiment be where working chamber pressure is increased from vapor pressure (Pv) to low pressure (Pl). Closing of the low pressure valve (204) will happen before the high pressure valve (10H) is opened (205). In the interval between the closing of the low pressure valve (10L) and opening of the high pressure valve (10L) the pressure of fluid trapped in the working chamber (4) will increase from low (Pl) to high pressure (Ph).

An example of an idling part of the cycle (I) and motoring part of the cycle (M) have been illustrated in FIG. 4. The motoring part (M) comprises a compression phase before the expansion phase producing torque, where the latter is indicated with a bold line segment in the volume graph.

In an alternative embodiment, the invention is a pump low torque embodiment, wherein a method the working chamber (4) is coming from pump mode, as illustrated in FIG. 5, wherein the high pressure valve (10H) is closed at or after reaching minimum working chamber volume (V) from expansion phase. In a working chamber cycle the method comprises keeping the low pressure valve (10L) open in a beginning of the expansion phase to allow a first amount of fluid (F1) into the working chamber (4), and keeping the low pressure valve (10L) closed in the rest of the cycle.

In a first dependent embodiment, the method comprises keeping the high pressure valve (10H) open in an end of the compression phase to allow the first amount of fluid (F1) out of the working chamber (4), and keeping the high pressure valve (10H) closed in the rest of the cycle.

In a second dependent embodiment that may be combined with any of the pump low torque embodiment and the first dependent embodiment above, the high pressure valve (10H) is opened in compression phase when working chamber pressure reaches high pressure (Ph) (303).

In a third dependent embodiment that may be combined with any of the pump low torque embodiment and any of its dependent embodiments above, the high pressure valve (10H) is closed at or right after reaching minimum working chamber volume (Vmin) (304).

In a fourth dependent embodiment that may be combined with any of the pump low torque embodiment and its dependent embodiments above, the low pressure valve (10L) is opened when reaching low pressure (I) in working chamber (4) (305). After the high pressure valve (10H) was closed, there is a short period where both valves are closed in expansion phase, and the pressure will drop.

In a fifth dependent embodiment that may be combined with any of the pump low torque embodiment and its dependent embodiment above, the low pressure valve (10L) is closed before the working chamber volume (V) has expanded to 1/3 or 1/4 of the maximum volume of the working chamber (4) (302). Further expansion will lower pressure in working chamber (4) to vapour pressure (Pv).

Any of the first to fifth dependent embodiments above, may also be combined independently, or together, with the first general low torque embodiment above, or its dependent embodiment.

As long as low torque pump mode is desired, the cycle may be repeated.

The exact opening of the high pressure valve (10H) may in an embodiment be where pressure is increased from vapor pressure (Pv) to high pressure (Ph) in the expansion phase.

The average torque produced depends on the fraction of the cycle that is motoring or pump mode (M, P) as illustrated in FIGS. 4 and 5. When this fraction is small, flow through the valves and corresponding pressure loss across the valves are limited.

In the exemplary embodiments, various features and details are shown in combination. The fact that several features are described with respect to a particular example should not be construed as implying that those features by necessity have to be included together in all embodiments of the invention. Conversely, features that are described with reference to different embodiments should not be construed as mutually exclusive. As those with skill in the art will readily understand, embodiments that incorporate any subset of features described herein and that are not expressly interdependent have been contemplated by the inventor and are part of the intended disclosure. However, explicit description of all such embodiments would not contribute to the understanding of the principles of the invention, and consequently some permutations of features have been omitted for the sake of simplicity or brevity.

The invention claimed is:

1. A hydraulic machine comprising:

at least one working chamber with cyclically varying volume;

controllable high and low-pressure valves, arranged between a fluid source and the at least one working chamber and at least one fluid sink and the at least one working chamber, respectively, wherein the fluid source has high pressure and the at least one fluid sink has low pressure; and a control system arranged to control opening and closing of said high and low-pressure valves, wherein the control system is configured to:

operate the hydraulic machine in an empty cylinder idle mode; and keep the high and low-pressure valves concurrently closed for at least a whole cycle of the varying volume, wherein the hydraulic machine comprises a first idle safety valve arrangement arranged between the at least one working chamber and the at least one fluid sink with a pressure lower than the high pressure, wherein the first idle safety valve arrangement is configured to release hydraulic fluid to the at least one fluid sink when it is enabled and if a fluid pressure in the at least one first working chamber increases above a set threshold, wherein the control system is arranged to:

enable the first idle safety valve arrangement when the hydraulic machine operates in the empty cylinder idle mode; and disable the first idle safety valve arrangement when the hydraulic machine does not operate in the empty cylinder idle mode.

2. The hydraulic machine of claim 1, wherein the first idle safety valve arrangement comprises a check valve arranged to release fluid to the at least one fluid sink.

3. The hydraulic machine of claim 2, wherein the first idle safety valve arrangement further comprises a valve comprising any of the following features:

a two way valve;

a solenoid valve connected to the control system; and a normally open or normally closed valve.

4. The hydraulic machine of claim 1, wherein the high and low-pressure valves are controlled via first and second electronically controlled pilot pressure controllers arranged between the control system and pilot ports of the high and low-pressure valves, respectively.

5. The hydraulic machine of claim 4, wherein a pilot main port of each of the first and second pilot pressure controllers is connected to the respective pilot port of the high and low-pressure valves, wherein each of the first and second pilot pressure controllers are connected to tank pressure and high pressure and are configured to vary pressure on the pilot ports between the tank pressure and high pressure.

6. The hydraulic machine of claim 1, wherein the at least one fluid sink includes a first sink connected to the low-pressure valve and a second sink connected to the safety valve.

7. A method for idling a hydraulic machine, wherein the hydraulic machine comprises:

at least one working chamber with cyclically varying volume;

controllable high and low-pressure valves arranged between a fluid source and the at least one working chamber and at least one fluid sink and the at least one working chamber respectively, wherein the fluid source has high pressure and the at least one fluid sink has low pressure; and a control system arranged to control opening and closing of said high and low-pressure valves, wherein a first idle safety valve arrangement is arranged between the at least one first working chamber and the at least one fluid sink with a pressure equal to or lower than the high pressure, and wherein the method comprises:

operating the hydraulic machine in an empty cylinder idle mode, wherein the high and low-pressure valves are concurrently closed for at least a whole cycle of the varying volume; and releasing hydraulic fluid to the at least one fluid sink only when fluid pressure in the at least one working chamber increases above a set threshold and the empty cylinder idle mode is enabled:

enabling the first idle safety valve arrangement when the hydraulic machine operates in the empty cylinder idle mode; and disabling the first idle safety valve arrangement when the hydraulic machine does not operate in the empty cylinder idle mode.

8. The method of claim 7, further comprising closing the low-pressure valve immediately after a minimum working chamber volume is passed.

9. The method of claim 7, further comprising enabling the first idle safety valve arrangement after closing of the low pressure valve and before the cyclically varying volume is reduced to the same volume as was present when the low pressure valve was closed.

10. The method of claim 8, further comprising:

closing the high-pressure valve immediately after minimum working chamber volume is passed; and enabling the first idle safety valve arrangement after the closure of the high pressure valve and before the varying volume is reduced to the same volume as was present when the high pressure valve was closed.

11. The method of claim 10, further comprising:

disabling the first idle safety valve arrangement; and opening the low-pressure valve.

12. The method of claim 7, further comprising keeping the high and low-pressure valves closed when the varying volume is larger than a set volume.

13. The method of claim 8, further comprising enabling the first idle safety valve arrangement after closing of the low pressure valve and before the cyclically varying volume is reduced to the same volume as was present when the low pressure valve was closed.

14. The method of claim 7, comprising controlling the high and low-pressure valves via first and second electronically controlled pilot pressure controllers arranged between the control system and pilot ports of the high and low-pressure valves, respectively.

15. The method of claim 14, wherein a pilot main port of each of the first and second pilot pressure controllers is connected to the respective pilot port of the high and low-pressure valves, wherein each of the first and second pilot pressure controllers are connected to tank pressure and high pressure, and the method comprises varying pressure on the pilot ports between the tank pressure and high pressure.

* * * * *